United States Patent [19]

Weiss et al.

[11] Patent Number: 4,834,173

[45] Date of Patent: May 30, 1989

[54] PRESSURE ACTUATED BAFFLE SEAL

[75] Inventors: Bruce W. Weiss, Onalaska, Wis.; Alan Dickey, Peoria, Ill.

[73] Assignee: American Standard Inc., New York, N.Y.

[21] Appl. No.: 123,617

[22] Filed: Nov. 20, 1987

[51] Int. Cl.[4] ..... F28D 7/00

[52] U.S. Cl. ..... 165/159; 165/162; 165/172

[58] Field of Search ..... 165/159, 162, 172, 178, 165/905, 181

[56] References Cited

U.S. PATENT DOCUMENTS

| | | | |
|---|---|---|---|
| 2,256,993 | 9/1941 | Van Vleet | 165/159 X |
| 2,873,098 | 10/1955 | Morgan | 165/159 |
| 3,182,720 | 12/1961 | Brown | 165/157 |
| 3,447,603 | 7/1967 | Jones | 165/177 |
| 3,616,848 | 11/1971 | Kaelin | 165/162 X |
| 4,159,035 | 6/1979 | Chartet | 165/172 |
| 4,159,741 | 7/1979 | Nonnenmann et al. | 165/172 |
| 4,316,503 | 2/1982 | Kurachi et al. | 165/172 |
| 4,401,157 | 8/1983 | Cadars | 165/172 |
| 4,456,059 | 6/1984 | Cadars | 165/172 |
| 4,475,588 | 10/1984 | Tsou | 165/162 X |
| 4,577,380 | 3/1986 | Warner | 29/157.3 |
| 4,578,850 | 4/1986 | Kerr et al. | 29/157.3 |
| 4,749,031 | 6/1988 | Fukumoto | 165/159 |

FOREIGN PATENT DOCUMENTS

| | | | |
|---|---|---|---|
| 72371 | 9/1916 | Austria | 29/157.3 |
| 0134984 | 4/1979 | Fed. Rep. of Germany | 165/159 |
| 1296988 | 5/1962 | France | 165/159 |
| 80721 | 3/1971 | German Democratic Rep. | 165/159 |
| 0985704 | 12/1982 | U.S.S.R. | 165/159 |
| 1198370 | 12/1985 | U.S.S.R. | 165/159 |

*Primary Examiner*—Margaret A. Focarino

*Attorney, Agent, or Firm*—William J. Beres; David L. Polsley; Robert J. Harter

[57] ABSTRACT

A perforated plastic baffle for a shell-and-tube heat exchanger includes pressure actuated tube seals. Heat exchanger tubes run lengthwise through a cylindrical shell, and baffles traverse the tubes. The pressure actuated seals line each baffle perforation through which the tubes extend. Each seal includes a flexible annular lip that surrounds the tube and extends upstream from the baffle. Fluid flowing through the shell and being redirected by the baffles provides a pressure differential that forces the seals' lips tightly against and around the tubes. In the absence of the fluid pressure differential, the sealing force is greatly reduced which enables the tubes to be easily inserted through the baffle perforations during assembly of the heat exchanger.

2 Claims, 4 Drawing Sheets

10
12
14
16
18
19
20
24
26
28
30
32
34
42
46
48
49
52
54
56
58

PRESSURE ACTUATED BAFFLE SEAL

TECHNICAL FIELD

The subject invention generally pertains to baffles of shell-and-tube heat exchangers, and more specifically to seals associated with such baffles.

BACKGROUND OF THE INVENTION

Shell-and-tube heat exchangers often employ baffles for directing fluid through the shell in a tortuous path across the tubes. The baffles include holes through which the tubes extend, thereby enabling the baffles to traverse the tubes. It is important to seal any radial clearance that may exist between the holes and the tubes to prevent fluid from bypassing the baffle.

Seals currently being used rely on radial interference to provide a compressive sealing force between the tubes and the holes. Although these seals may be effective, the same compressive forces make it difficult to insert the tubes through the holes at assembly and may even damage delicate heat transfer fins extending from the tubes. In addition, a lack of radial clearance between the tubes and the holes provides no tolerance for radial misalignment.

Therefore, an object of the invention is to provide a pressure actuated seal whose radial sealing force increases in response to an increase in a fluid pressure differential across the baffle.

Another object of the invention is to provide a seal that accommodates concentric misalignment of the tubes with respect to the baffle's holes.

Another object is to provide a baffle that offers its tubes rigid support once the baffle seals have deflected beyond a certain point.

Yet another object is to provide a seal that exerts a significantly lower radial sealing force during assembly than during operation. which reduces the axial forces and minimizes damage to delicate tube fins when the tube is inserted through the baffle holes.

A further object is to provide a baffle made of a unitary piece of plastic and having integral tube seals.

A still further object is to provide a baffle having seals that accept tubes with a smooth land portion having an outer diameter that can range from less than to greater than an outer diameter of the tube's heat transfer fins.

These and other objects of the invention will be apparent from the Description of the Preferred Embodiment which follows hereinbelow and the attached drawings.

SUMMARY OF THE INVENTION

A shell-and-tube heat exchanger includes a perforated plastic baffle for directing fluid in a tortuous path through the shell and across a bundle of heat exchanger tubes. The baffle traverses the tubes which extend through the holes in the baffle. The hole diameter is greater than the tube diameter to provide a radial clearance therebetween which accommodates radial tube misalignment within the hole and facilitates assembly. A thin flexible lip disposed around each hole tightly seals around each tube and extends upstream to prevent fluid from bypassing the baffle through the clearance. Each lip, being exposed to both downstream fluid pressure (via the radial clearance) and upstream pressure, provides a pressure actuated seal that exerts a sealing force against the tubes that increase with the upstream-downstream pressure differential.

FIG. *6a–d* illustrates the baffle accommodating various tube designs.

FIG. *7a* is an enlarged view of the baffle seal of the preferred embodiment.

FIG. *7b–h* illustrate other embodiments of the invention.

DESCRIPTION OF THE PREFERRED EMBODIMENT

Figure 1:
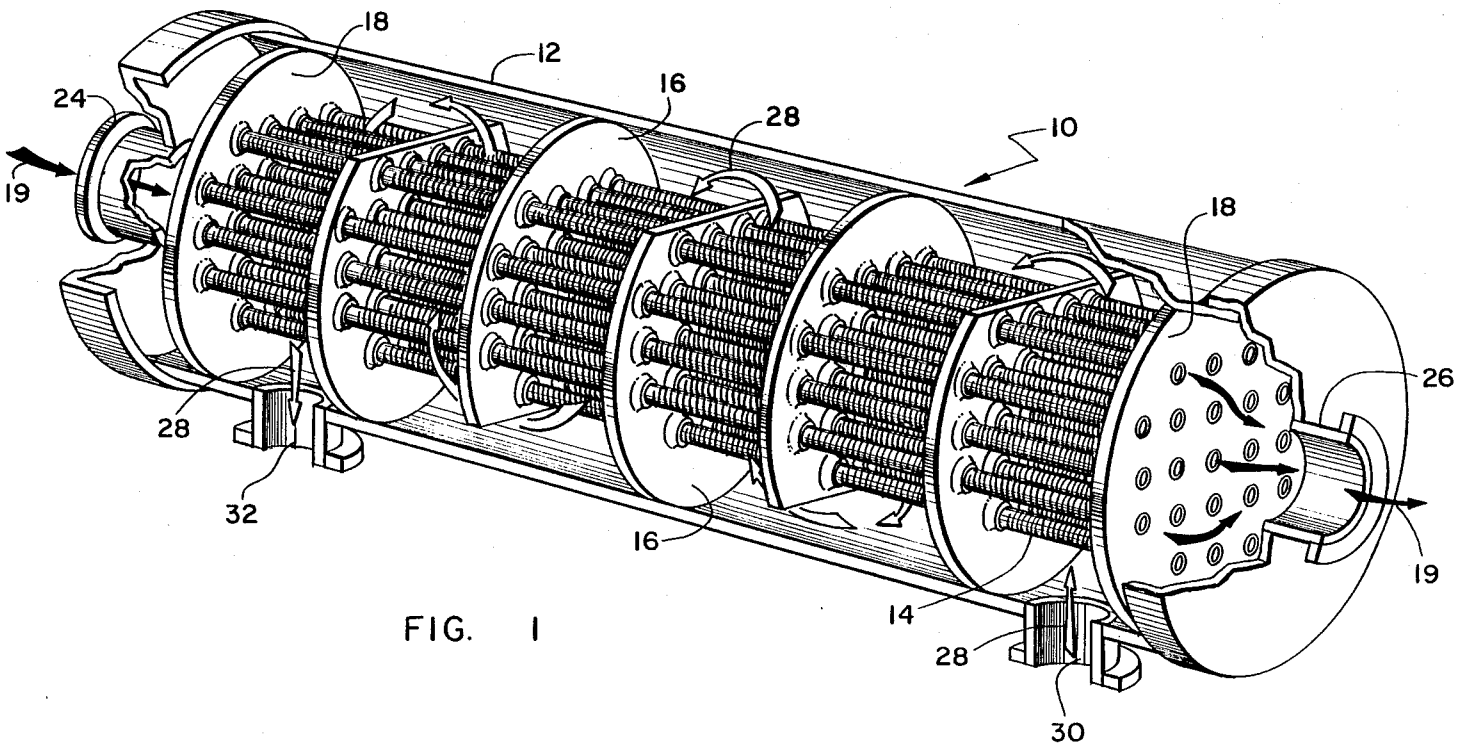
FIG. 1 shows a cutaway perspective view of the preferred embodiment of the invention.
Figures 2, 5, 6B, 6C, 6D:
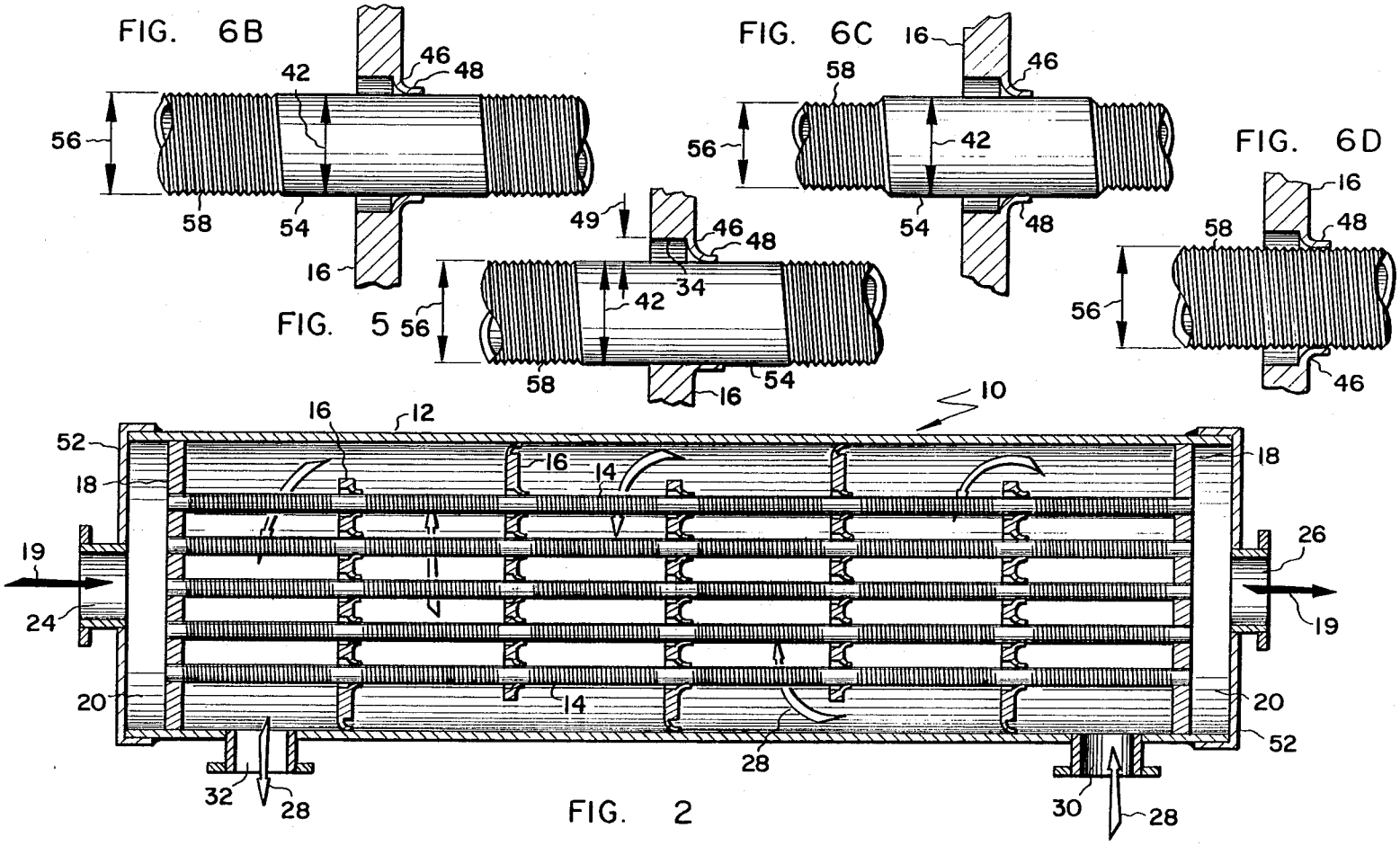
FIG. 2 shows a longitudinal cross-section of the FIG. 1.
FIG. 5 illustrates how the baffle seal accommodates misalignment and how the baffle can support the tube's weight.

A heat exchanger 10, shown in FIGS. 1 and 2, includes a shell 12, heat exchanger tubes 14, baffles 16, and end plates 18. End plates 18 are welded to shell 12 to define hermetically sealed inlet and outlet chambers 20. Chambers 20 are open to the interior of the tubes but are isolated from their exterior in the region between plates 18. Refrigerant 19 entering heat exchanger 10 at an inlet 24 is conveyed by tubes 14 from one chamber 20 to the other and exits through an outlet 26. Water 28, which is to be heated or cooled by refrigerant 19, enters an inlet 30 and is guided by baffles 16 to pass back and forth across tubes 14 before exiting at an outlet 32.

Figure 3:
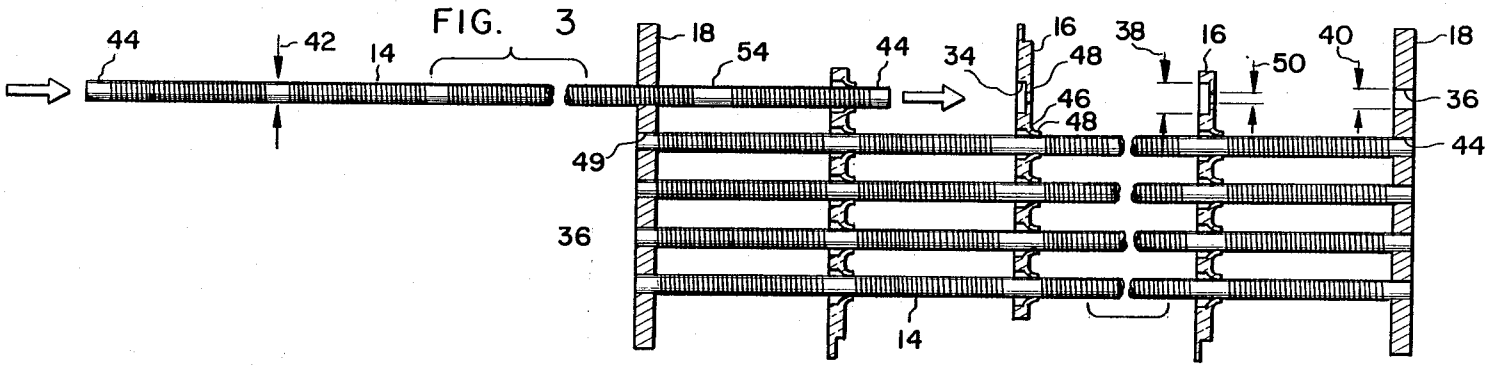
FIG. 3 and 4 shows the assembly of a shell-and-tube heat exchanger employing the invention.
Figure 4:
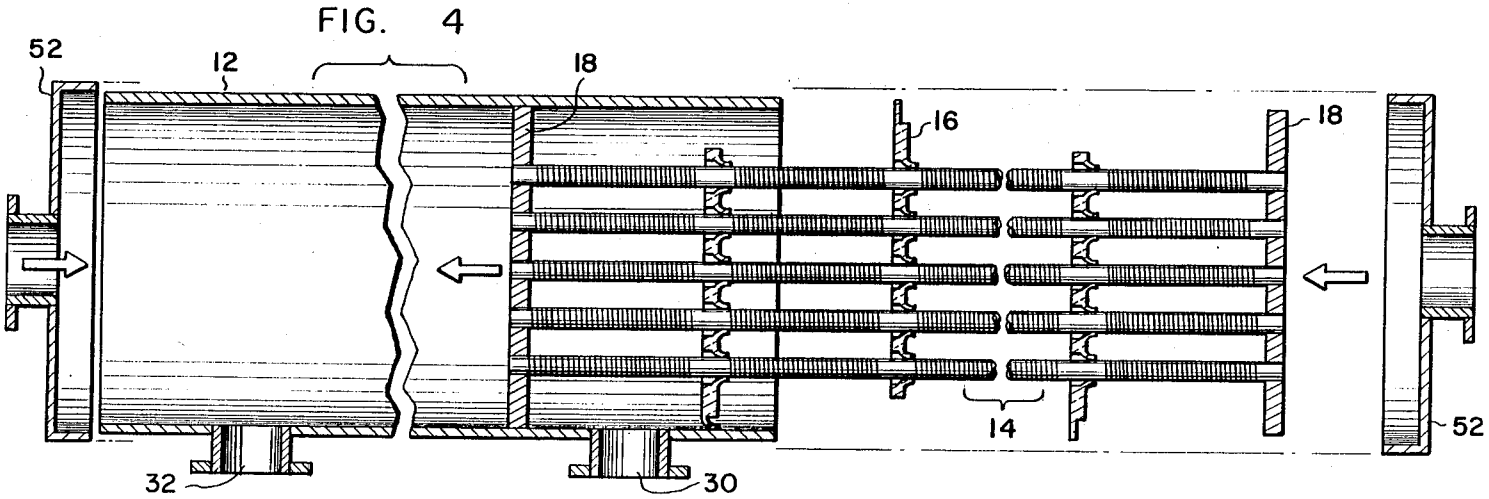
Figure 7A:
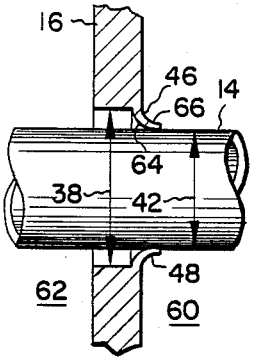
Figure 7B:
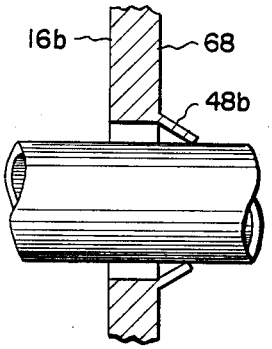
Figure 7C:
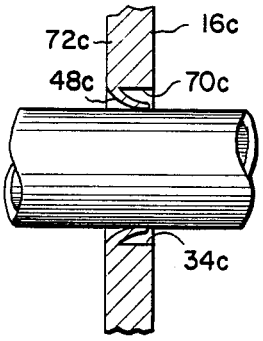
Figure 7D:
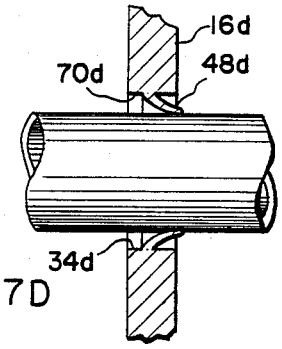
Figure 7E:
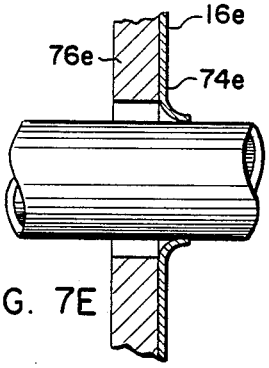
Figure 7F:
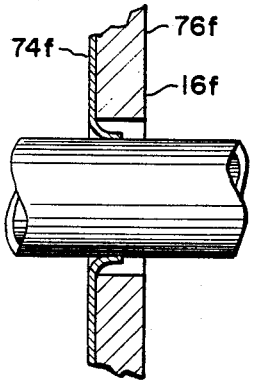
Figure 7G:
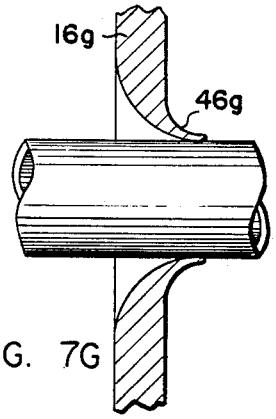
Figure 7H:
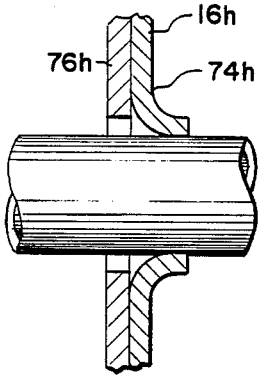
Figure 6A:
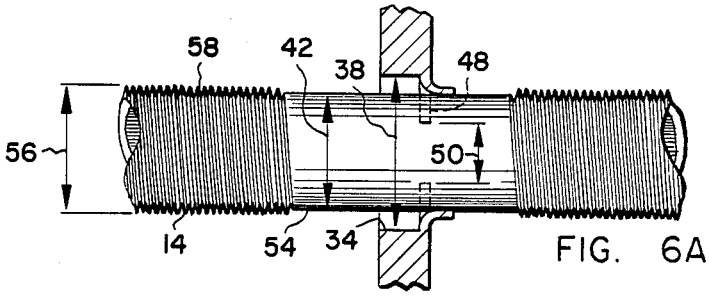

FIGS. 3 and 4 generally show how heat exchanger 10 is assembled. Baffles 16 and end plates 18 are positioned as shown, and tubes 14 are inserted through baffle holes 34 and end plate holes 36. Both holes 34 and 36 have inner diameters 38 and 40 respectively that are greater than an outer diameter 42 of tubes 14 to enable easy insertion. Once in place, tube ends 44 are swaged radially outward to provide a hermetic seal against holes 36. Tubes seals 46, which form an integral part of baffle 16, eliminate the need for swaging where tubes 14 extend through holes 34. As can be seen in FIG. 3, each seal 46 includes a thin flexible annular lip 48 that has an unstretched inner diameter 50 that is smaller than the tube outer diameter 42. As tubes 14 are inserted through holes 34 lips 48 readily stretch radially outward and extend axially in a direction that will be upstream during operation. Once the tube and baffle assembly is complete, as shown in FIG. 4, the assembly is inserted in shell 12, end plates 18 are welded to the shell, and two end caps 52 are attached to shell 12.

Referring to FIG. 5, the relatively large outer diameter of baffle holes 34 and the flexibility of lips 48, allow for radial misalignment of tubes 14 within holes 34. Yet the misalignment is limited to within a reasonable predetermined range as defined by the radial clearance 49 between tube 14 and hole 34. If the misalignment is a result of the tube's weight forcing the tube to bow downward, baffle 16, being more rigid than seal 46, provides support for the tube.

In addition, the relatively large outer diameter 38 and the flexibility of lips 48 make seals 46 suitable for a variety of tube sizes and shapes as shown in FIGS. *6a–d*. In FIGS. *6a–c*, the inner diameter 50 of the unstretched lip 48 is smaller than the outer diameter 42 of a smooth land portion 54 of tube 14. And the inner diameter 38 of holes 34 is larger than outer diameters 42 and 56 of both the land portion 54 and finned portion 58 respectively. These relative dimensions facilitate assembly and tolerate misalignment. In FIG. *6a*, diameter 42 is smaller than diameter 56; in FIG. *6b*, diameter 42 is approximately equal to diameter 56; in FIG. *6c*, diameter 42 is greater than diameter 56; and in FIG. *6d*, tube 14 does not include a land portion 54. Although FIG. *6a* illustrates the preferred embodiment, any of the tube designs of FIG. *6a–d* would be acceptable, keeping in mind that the design shown in Figure d may result in some leakage across the seal.

The specific seal design of the preferred embodiment is shown in FIG. *7a;* however, it should be noted that other embodiments, such as those illustrated in FIGS. *7b–h* are also within the scope of the invention. Baffle 16 of FIG. *7a* is made of a unitary piece of plastic that includes an integral seal 46. The single-piece construction simplifies manufacturing by eliminating subassemblies and their resulting joints. It should be appreciated, however, that materials other than plastic would also work provided the properties of the material suit the specific application. More specifically, the material should be compatible with the fluid it contacts, be able to withstand the fluid temperature and dynamic pressures, have sufficient flexibility to respond to a fluid pressure differential across the seal, have sufficient elasticity to enable the seal to stretch over the tube, and have enough rigidity to radially support some weight of the tube.

Baffle 16, of FIG. *7a*, is shown dividing fluid (water 28) between an upstream side 60 and a lower pressure downstream side 62. Inner diameter 38, being larger than tube diameter 42, exposes a backside 64 of the seal's lip to the lower downstream pressure, while a front side 66 of the seal's lip is exposed to the higher upstream pressure. The pressure differential across the baffle (upstream minus downstream) urges the seal's lip 48 downstream and radially against tube 14 to provide a pressure actuated seal. The other embodiments of the invention shown in FIGS. *7b–h* operate under the same basic principle.

In FIG. *7b*, lip **48*b* extends from an upstream face 68 of baffle 16*b***, rather than from an inner circumference of the baffle hole as in FIG. *7a*.

In FIG. *7c*, lip **48*c* extends from an inner circumference 70*c* of hole 34*c* but is attached near a backside 72*c* of baffle 16*c*** instead of near the front.

In FIG. *7d*, lip **48*d* extends from the inner circumference 70*d* of hole 34*d* at an intermediate point between the front and backside of baffle 16*d***.

Baffle **16*e***, of FIG. *7e*, is a two-piece assembly having a thin flexible seal member **74*e* with a rigid back plate 76*e***.

Baffle **16*f***, shown in FIG. *7f*, is similar to the one shown in FIG. *7e* except that seal member **74*f* is attached to the backside of back plate 76*f***.

FIG. *7g* shows a baffle **16*g* having a smooth transition where a relatively thin seal 46*g*** extends from the baffle.

In FIG. *7h*, baffle **16*h* includes a flexible seal 74*h* attached to a more rigid back plate 76*h*** but with both having generally the same thickness.

Although the invention is described with respect to a preferred embodiment, modifications thereto will be apparent to those skilled in the art. Therefore the scope of the invention is to be determined by reference to the claims which follow:

We claim:

1. A heat exchanger comprising:

a. a shell for conveying a fluid therethrough;

b. a baffle of substantially uniform thickness disposed inside said shell and having a plurality of holes with a symmetrical resilient annular lip integrally disposed in full continuity around each of said holes to comprise a single unitary polymeric piece free of any assembly joints, said lips extending from an upstream side of said baffle and being exposed to said fluid at both said upstream and a downstream side of said baffle, said baffle being at least four times thicker than said seals to provide said seals with a substantially greater flexibility than that of said baffle; and c. a plurality of heat exchanger tubes having an outer diameter that is greater than an unstretched inner diameter of said lips, said tubes extending through said holes and said annular lips so that said tubes stretch said lips radially outward and deflect said lips toward said upstream side of said baffle, whereby said lips exert a radial sealing force against said tubes that increases with a fluid pressure differential existing across said baffle, said outer diameter of said tubes being smaller than an inner diameter of said holes for providing a radial clearance between each of said tubes and the inner diameter of each of said holes to accommodate radial misalignment of said tubes within said holes while still providing radial support of said tubes if needed, said lips having a radial length greater than said radial clearance to ensure a positive seal even when said radial misalignment results in said tubes being forced against said baffle.

2. A heat exchanger comprising:

a. a shell for conveying a fluid therethrough;

b. a baffle of substantially uniform thickness disposed inside said shell and having a plurality of holes with a symmetrical resilient annular lip integrally disposed in full continuity around each of said holes to comprise a single unitary polymeric piece free of any assembly joints, said lips extending from an inner circumference of each of said holes at an intermediate point between an upstream side and a downstream side of said baffle and being exposed to said fluid at both sid upstream and said downstream side of said baffle, said baffle being at least four times thicker than said seals to provide said seals with a substantially greater flexibility than that of said baffle; and c. a plurality of heat exchanger tubes having an outer diameter that is greater than an unstretched inner diameter of said lips, said tubes extending through said holes and said annular lips so that said tubes stretch said lips radially outward and deflect said lips toward said upstream side of said baffle, whereby said lips exert a radial sealing force against said tubes that increases with a fluid pressure differential existing across said baffle a, said outer diameter of said tubes being smaller than an inner diameter of said holes for providing a radial clearance between said tube and the inner diameter of said holes to accommodate radial misalignment of said tubes within said holes while still providing radial support of said tube if needed, said lips having a radial length greater than said radial clearance to ensure a positive seal even when said radial misalignment results in said tube being forced against said baffle.

* * * * *